US005691107A

United States Patent [19]

Kaneko et al.

[11] Patent Number: 5,691,107

[45] Date of Patent: Nov. 25, 1997

[54] SILVER HALIDE PHOTOGRAPHIC PHOTOSENSITIVE MATERIAL

[75] Inventors: Satoshi Kaneko; Akira Tanaka, both of Tokyo, Japan

[73] Assignee: Mitsubishi Paper Mills Limited, Tokyo, Japan

[21] Appl. No.: 603,352

[22] Filed: Feb. 20, 1996

Related U.S. Application Data

[63] Continuation of Ser. No. 351,597, Dec. 7, 1994, abandoned.

[51] Int. Cl.[6] ..... G03C 1/06

[52] U.S. Cl. ..... 130/264; 430/267; 430/627; 430/631; 430/637

[58] Field of Search ..... 430/264, 267, 430/637, 631, 627

[56] References Cited

U.S. PATENT DOCUMENTS

| | | | |
|---|---|---|---|
| 3,879,205 | 4/1975 | Fitzgerald et al. | 430/627 |
| 4,278,759 | 7/1981 | Saleck et al. | 430/627 |
| 5,279,920 | 1/1994 | Onodera et al. | 430/264 |
| 5,283,158 | 2/1994 | Onodera et al. | 430/264 |

FOREIGN PATENT DOCUMENTS

| | | |
|---|---|---|
| 4318438 | 6/1993 | Germany . |
| 2-41 | 1/1990 | Japan . |
| 3-59640 | 3/1991 | Japan . |
| 6-180480 | 6/1994 | Japan . |

*Primary Examiner*—Geraldine Letscher
*Attorney, Agent, or Firm*—Cushman Darby & Cushman IP Group of Pillsbury Madison & Sutro LLP

[57] ABSTRACT

The present invention provides a silver halide photographic photosensitive material which comprises a support and at least one silver halide photographic emulsion layer, a hydrazine compound being contained in at least one of the emulsion layer and other hydrophilic colloid layer, characterized in that at least one of the emulsion layer and other hydrophilic colloid layer contains a water-soluble polymer having an amino group exclusive of a primary amino group as a promoter for enhancement of contrast. By using the said silver halide photographic photosensitive material, images of high contrast can be formed using a developer of low pH value without causing change in photographic performances even when the pH value changes.

7 Claims, No Drawings

SILVER HALIDE PHOTOGRAPHIC PHOTOSENSITIVE MATERIAL

This is a continuation of application No. 08/351,597, filed on Dec. 7, 1994, which was abandoned upon the filing hereof.

BACKGROUND OF THE INVENTION

The present invention relates to a silver halide photographic photosensitive material and a method for forming a superhigh contrast negative image using the photosensitive material and in particular, to a silver halide photographic photosensitive material used for photomechanical process.

Recently, colored prints or complicated prints have been rapidly developed in the field of printing photomechanical process. Accordingly, demand for improvement and stabilization of the quality of silver halide photosensitive materials for printing (hereinafter referred to as "printing photosensitive materials") which are intermediate media in printing increases yearly. Conventionally, general printing photosensitive materials have been imparted with so-called suitability for lith developing for attaining a high quality. However, in the lith development, a sulfite ion which is a preservative can hardly be contained in the developer for structural reasons. Therefore, it is well known for one skilled in the art that stability of the developer is very poor. In an attempt to solve the unstability of lith development and to obtain images having the contrast as high as that obtained by lith development, some proposals have been made in patents. For example, techniques of obtaining high contrast images using hydrazine compounds are disclosed in Japanese Patent Kokai (Laid-Open) Nos. 53-16623, 53-20921, 53-20922, 53-49429, 53-66732, 55-90940, 56-67843, 57-99635, 62-73256, 62-275247, 62-178246, 62-180361, 63-121838, 63-223744, 63-234244, 63-253357, 64-90439, 1-105943, 2-25843, 2-120736, 2-37, 2-8834, 3-125134, 3-184039, 4-51143, etc. It is necessary for obtaining high contrast images that the developers containing these hydrazine compounds have a relatively high pH value. However, developers having a high pH value absorb carbon dioxide in the air and as a result, decrease in the pH value. Furthermore, stability against air oxidation is not necessarily sufficient and effective life of the developers is short.

An attempt to make the hydrazine derivatives more active for enhancing the contrast at a low pH value to solve the above defects has been made as disclosed in Japanese Patent Kokai (Laid-Open) Nos.60-179734 and 62-948 and U.S. Pat. Nos.4,385,108 and 4,269,929. Furthermore, various promoters for enhancement of contrast are described in Japanese Patent Kokai (Laid-Open) Nos.61-165752, 62-222241, 63-124045 and 2-8833. However, these promoters can accelerate the development, but have substantially no effect to lower the pH value. There is the limit in lowering the pH value by the use of these promoters in combination with highly active hydrazines. On the other hand, the promoters disclosed in Japanese Patent Kokai (Laid-Open) No.2-170155 can lower the pH of developers when used with highly active hydrazines, but have the problem that the photographic performance changes greatly when pH of developers changes. Even a slight change in the pH value causes increase of dot area or change in line width of line images.

SUMMARY OF THE INVENTION

The first object of the present invention is to provide a silver halide photographic photosensitive material which can produce a high contrast image using a hydrazine compound and a developer of low pH value and which hardly changes in its photographic performance with change of the pH value.

The second object is to provide a photosensitive material for printing plates which contains an effective promoter which shows accelerating action for contrast enhancement with use in a small amount.

The third object of the present invention is to provide a silver halide photographic photosensitive material which hardly changes in its photographic performance with change of compositions of the developers.

These objects have been attained by a silver halide photographic photosensitive material which comprises a support and at least one silver halide photographic emulsion layer on the support, at least one of the emulsion layer and other hydrophilic colloid layers containing a hydrazine compound, characterized in that the silver halide photographic photosensitive material contains a water-soluble polymer having an amino group other than primary amino group as a promoter for enhancement of contrast.

DESCRIPTION OF THE INVENTION

As the hydrazine compounds used in the present invention, mention may be made of those which are represented by the following formula (2):

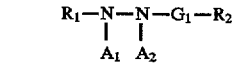

$$R_1-\underset{\underset{A_1}{|}}{N}-\underset{\underset{A_2}{|}}{N}-G_1-R_2 \qquad (2)$$

wherein $A_1$ and $A_2$ both represent hydrogen atom or one of them represents a hydrogen atom and the other represents a sulfonyl group or an acyl group, $R_1$ represents an aliphatic group, an aromatic group or a heterocyclic group, $G_1$ represents a carbonyl group, a sulfonyl group, a sulfoxy group, a phosphoryl group, an oxalyl group or an iminomethylene group, and $R_2$ represents a hydrogen atom, an aliphatic group, an aromatic group, an alkoxy group, an aryloxy group, an amino group or a group represented by the formula (3):

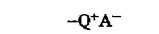

$$-Q^+A^- \qquad (3)$$

wherein $Q^+$ represents a group containing a cationic group and $A^-$ represents an anion which is not necessary when $Q^+$ contains a sulfo group.

The formulas (2) and (3) will be explained in detail.

In the formula (2), $A_1$ and $A_2$ are hydrogen atom, alkylsulfonyl group of 20 or less carbon atoms, arylsulfonyl group of 20 or less carbon atoms (preferably a phenylsulfonyl or a phenylsulfonyl group substituted so that sum of Hammett' $\sigma_p$ is −0.5 or more), acyl group of 20 or less carbon atoms (preferably benzoyl group or benzoyl group substituted so that sum of Hammett' $\sigma_p$ is −0.5 or more), or unsubstituted or substituted and straight chain, branched chain or cyclic aliphatic acyl group (the substituents include halogen atom, ether group, sulfonamide group, amide group, hydroxy group, carboxy group and sulfo group), and $A_1$ and $A_2$ are most preferably hydrogen atoms. The aliphatic groups represented by $R_1$ include a straight chain, branched chain or cyclic alkyl, alkenyl and alkynyl groups. The aromatic groups represented by $R_1$ include monocyclic or bicyclic aryl groups such as phenyl group and naphthyl group. The heterocyclic groups of $R_1$ include 3–10 membered saturated or unsaturated heterocyclic groups containing at least one of N, O and S atoms and these may be monocyclic or may form condensed rings with other aromatic rings or heterocyclic rings. Preferred are 5- or 6-membered aromatic heterocyclic rings and preferable examples thereof are those which contain pyridyl group, imidazolyl group, quinolinyl group, benzimidazolyl group, pyrimidyl group, pyrazolyl group, isoquinolinyl group, thiazolyl group or benzothiazolyl group.

$R_1$ may be substituted and as the substituents, mention may be made of, for example, the following groups, which may further be substituted: alkyl group, aralkyl group, alkoxy group, aryl group, substituted amino group, acylamino group, sulfonylamino group, ureido group, urethane group, aryloxy group, sulfamoyl group, carbamoyl group, aryl group, alkylthio group, arylthio group, sulfonyl group, sulfinyl group, hydroxy group, halogen atom, cyano group, sulfo group, carboxy group, pyridinium group, thiouronium group, and isothioureido group. If possible, these groups may link to each other to form a ring. $R_1$ is preferably an aromatic group, more preferably an aryl group. Furthermore, $R_1$ may contain a ballast group customarily used in immobile photographic additives such as couplers. The ballast groups are groups having 8 or more carbon atoms which are relatively inert to photographic properties. For example, they can be selected from alkyl group, alkoxy group, phenyl group, alkylphenyl group, phenoxy group, alkylphenoxy group and others. $Q^+$ in the formula (3) is a group containing a cationic group having at least one quaternary nitrogen atom and may bond to $G_1$ through a straight or branched hydrocarbon chain having 1–4 carbon atoms and a part or the whole of this chain may constitute a part of heterocyclic ring having a quaternary nitrogen atom. Preferable examples of $Q^+$ are trialkylammonioalkyl group, pyridinium-1-ylalkyl group, 1-alkylpyridinium-2-yl group, 1-alkylpyridinium-3-yl group, 1-alkylpyridinium-4-yl group, thiazolinium-3-ylalkyl group, oxazolinium-3-ylalkyl group, and 1-alkylimidazolium-3-ylalkyl group. These groups may be substituted and the substituents are preferably those which are mentioned above as the substituents of $R_1$. Furthermore, when these groups form a ring structure, they may condense with other rings. $A^-$ is a counter ion for $Q^+$ and preferable examples are $Cl^-$, $Br^-$, p-toluenesulfonate and methylsulfonate. $A^-$ is not present when $Q^+$ has sulfo group as a substituent and an internal salt is formed.

$G_1$ represents a carbonyl group, a sulfonyl group, a sulfoxy group, a phosphoryl group, an oxalyl group or an iminomethylene group and preferred are carbonyl group and oxalyl group. The aliphatic group represented by $R_2$ is preferably an alkyl group of 1–5 carbon atoms and the aromatic group is preferably a monocyclic or bicyclic aryl group (such as one containing benzene group). When $G_1$ is a carbonyl group, the groups represented by $R_2$ are preferably hydrogen atom, alkyl groups (such as methyl group, trifluoromethyl group, 3-hydroxypropyl group, 3-methanesulfonamidepropyl group and phenylsulfonylmethyl group), aralkyl groups (such as 2-hydroxybenzyl group), and aryl groups (such as phenyl group, 3,5-dichlorophenyl group, 2-methanesulfonamidephenyl group, 4-methanesulfonamidephenyl group and 2-hydroxymethylphenyl group), and hydrogen atom and those of the formula (3) are especially preferred. $R_2$ may be substituted and as the substituents, those which are enumerated for $R_1$ can be applied. When $G_1$ is an oxalyl group, the groups represented by $R_2$ are preferably alkoxy groups (such as methoxy group, ethoxy group, isopropoxy group, and methoxyethoxy group), aryloxy groups (such as phenoxy group, 2-hydroxymethylphenoxy group, and 4-chlorophenoxy group), amino groups (such as 3-hydroxypropylamino group, 2,3-dihydroxypropylamino group, 2-dimethylaminoethylamino group and 3-diethylaminopropylamino group) and those of the formula (3). The amino groups are especially preferred. $R_1$ and $R_2$ may contain a group which enhances adsorption to the surface of silver halide grains. As such adsorption groups, mention may be made of those which are described in U.S. Pat. No. 4,355,105, such as thiourea group, heterocyclic thioamide group, mercapto heterocyclic group and triazole group. Furthermore, $R_2$ may be such one which splits the $G_1$-$R_2$ portion from the remainder molecule and brings about a cyclizing reaction which produces a cyclic structure containing the atom of —$G_1$-$R_2$ portion. Examples thereof are those described in Japanese Patent Kokai (Laid-Open) No.63-29751. Non-limiting typical examples of the compounds represented by the formula (2) are enumerated below.

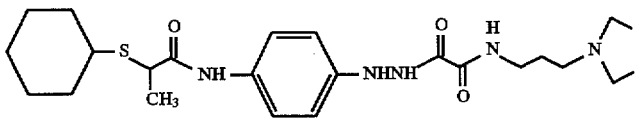

H-1

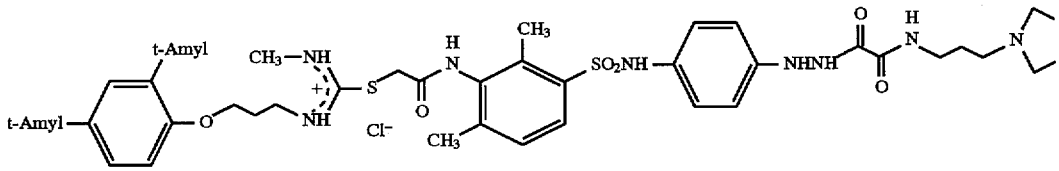

H-2

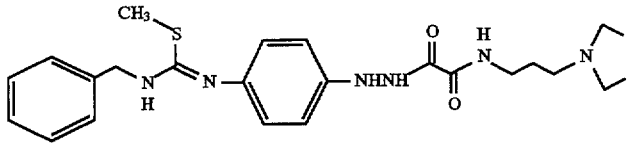

H-3

-continued
H-4
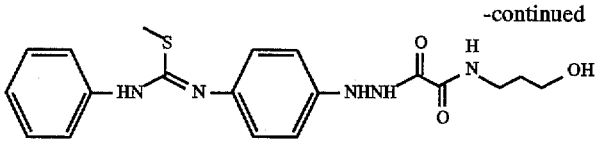
H-5
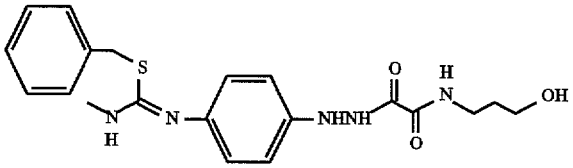
H-6
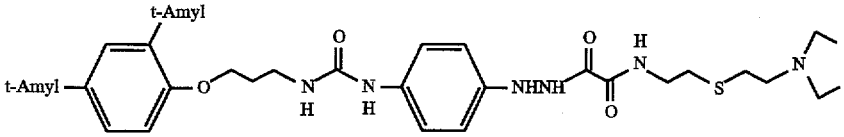
H-7
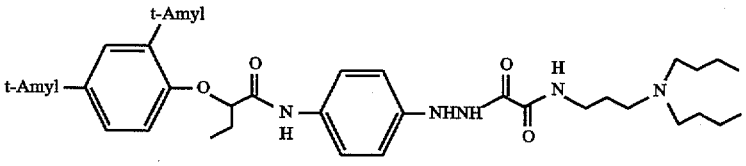
H-8
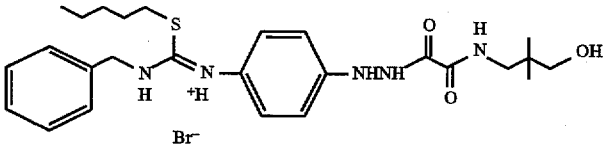
H-9
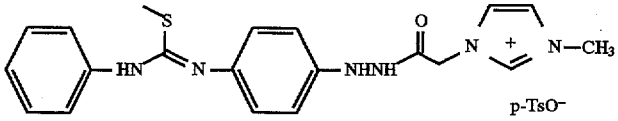
H-10
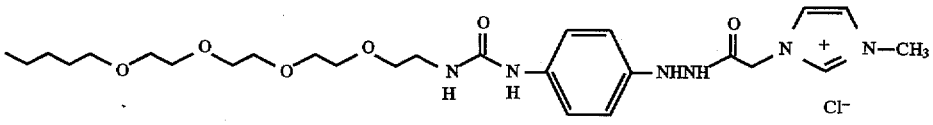
H-11
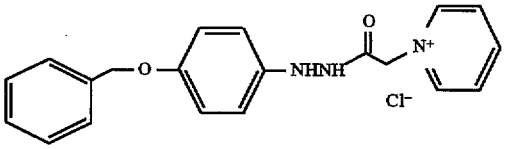
H-12
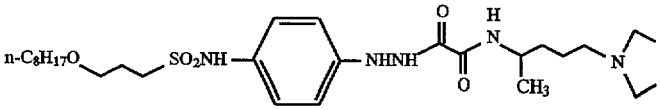
H-13
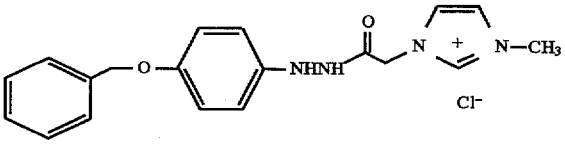
H-14
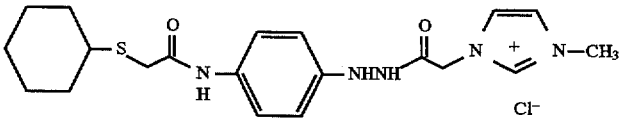

-continued
H-15
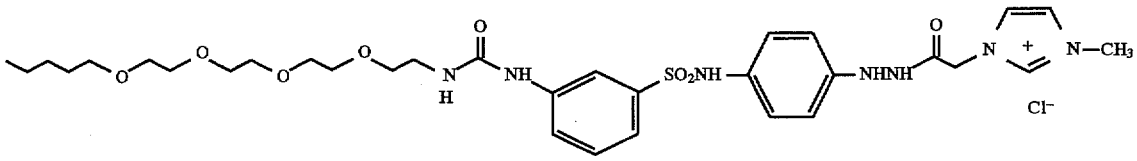
H-16
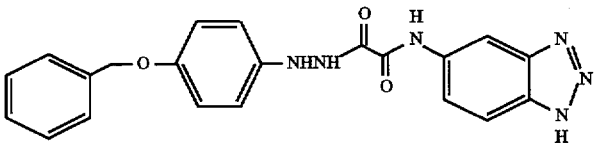
H-17
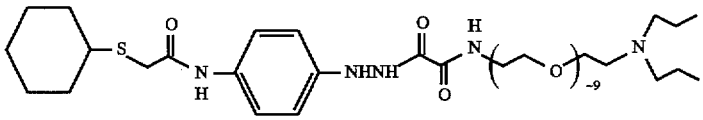
H-18
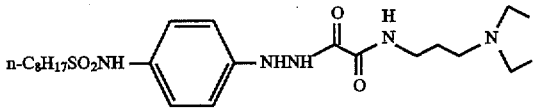
H-19
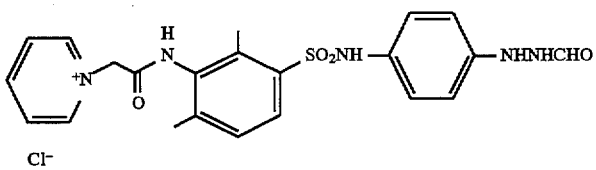
H-20
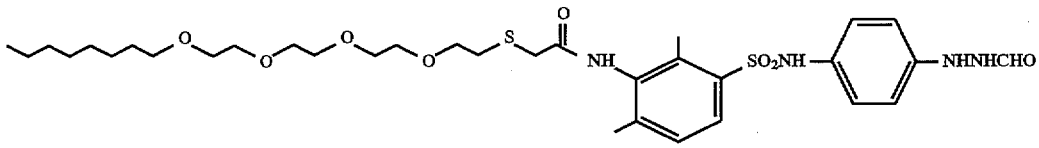
H-21
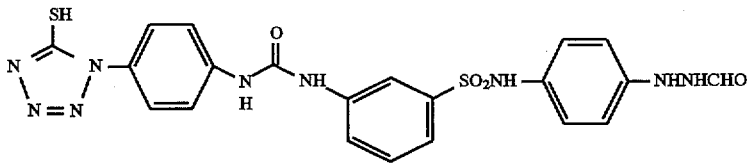
H-22
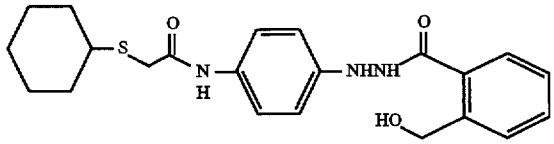
H-23
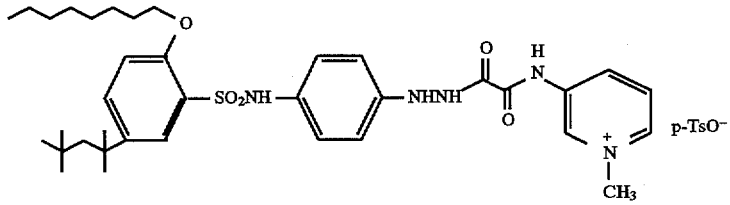
H-24
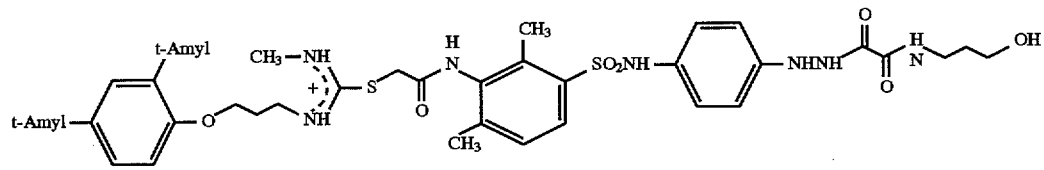

-continued

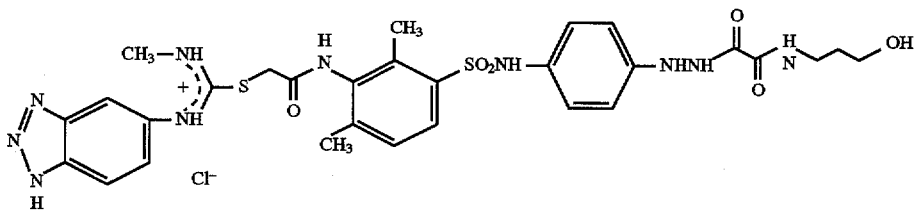

H-25

The hydrazine compounds used in the present invention can be prepared utilizing the processes described, for example, in Japanese Patent Kokai (Laid-Open) Nos.61-213847, 62-178246, 62-180361, 62-260153, 63-98803 and 63-253357, and U.S. Pat. Nos.4,684,604, 3,379,529, 4,377,634 and 4,332,878.

The hydrazine compounds can be used in the form of solutions prepared by dissolving in suitable water-miscible organic solvents, for example, alcohols (such as methanol, ethanol, propanol and fluorinated alcohols), ketones (such as acetone and methyl ethyl ketone), dimethylformamide, dimethylacetamide, dimethylsulfoxide and methyl cellosolve. Furthermore, they may be dissolved using oils such as dimethyl phthalate, tricresyl phosphate, glyceryl triacetate and diethyl phthalate or co-solvents such as ethyl acetate and cyclohexanone by the well-known emulsification dispersing method to mechanically prepare a emulsified dispersion. Alternatively, powders of hydrazine compounds are dispersed in water by ball mill, colloid mill or ultrasonic by a method known as a solid dispersing method.

The silver halides used in the photosensitive silver halide emulsion of the photosensitive material of the present invention are unlimited, but preferred are surface latent image type silver halide emulsions. As the silver halides, there may be used silver chloride, silver chlorobromide, silver chloroiodobromide, silver iodobromide, silver bromide, etc. When silver chloroiodobromide and silver iodobromide are used, content of silver iodide is preferably in the range of 5 mol % or less. Crystal form, crystal habit and size distribution of silver halide grains are unlimited, but preferred are those which have a grain size of 0.7 micron or smaller. Sensitivity of the silver halide emulsions can be enhanced by gold compounds such as chloroaurates and gold trichloride, salts of noble metals such as rhodium and iridium, sulfur compounds which react with silver salts to form silver sulfide or reducing materials such as stannous salts and amines without coarsening the grains. Furthermore, salts of noble metals such as rhodium and iridium and iron compounds such as potassium ferricyanide can be allowed to be present during pysical ripening of silver halide grains or during nucleation. Especially, addition of a rhodium salt or a complex salt thereof is preferred because it further promotes the effect of the present invention to attain the high contrast photographic characteristics in a short developing time.

In the present invention, the surface latent image type silver halide emulsion means an emulsion comprising silver halide grains having a surface sensitivity which is higher than the internal sensitivity. This emulsion is preferably one having a difference in surface sensitivity and internal sensitivity as specified in U.S. Pat. No. 4,224,401. The silver halide emulsion is desirably monodispersed emulsion and especially preferably has a monodispersibility specified in the above U.S. Pat. No. 4,224,401. The silver halide emulsion used in the present invention preferably contains water-soluble rhodium salts such as rhodium dichloride, rhodium trichloride, potassium hexachlororhodate (III), and ammonium hexachlororhodate (III) and these rhodium salts are preferably added before completion of the first ripening in preparation of the emulsion. Amount of the rhodium salts is preferably $1\times10^{-7}$ to $1\times10^{-4}$ mol per 1 mol of silver halide. The average grain size of the silver halide used in the present invention is preferably 0.5 μm or smaller, especially preferably 0.1–0.4 μm. The silver halide grains may be in the regular form such as cube or octahedron or in the form of mixed crystal, but is preferably so-called monodispersed emulsion having a relatively narrow grain size distribution. The monodispersed emulsion here means an emulsion comprising silver halide grains in which 90% or more, preferably 95% or more of total grains have a size within ±40% of the average grain size. Any of single jet method, double jet method or reverse mixing method carried out in the presence of excess silver ion may be used for reacting a soluble silver salt with a soluble halogen salt to prepare the silver halide emulsion used in the present invention, but for the purpose of the present invention, the double jet method is preferred in which the grains are formed by simultaneously adding a soluble silver salt and a soluble halogen salt in the presence of an acidic solution. The thus prepared silver halide emulsion may be or may not be chemically sensitized. It is rather preferred not to effect the chemical sensitization from the point of improving handeability under the condition of safelight which can be called substantially a daylight room. In the case of effecting the chemical sensitization, there may be employed usual sulfur sensitization, selenium sensitization, tellurium sensitization and reduction sensitization.

The hydrazine compound is preferably contained in the silver halide emulsion layer in the photosensitive material of the present invention, but it may be contained in a hydrophilic colloid layer contiguous to the surface latent image type silver halide emulsion layer. The hydrophilic colloid layer may be any layer having any function as far as it does not hinder the hydrazine compound from diffusing into the silver halide grains, and include, for example, undercoat layer, intermediate layer, filter layer, protective layer or antihalation layer. Content of the hydrazine compound in the layer can vary over a wide range since it varies depending on the characteristics of the silver halide emulsion used, chemical structure of the compound and developing conditions, but the content in the range of about $1\times10^{-6}$ to $1\times10^{-2}$ mol per 1 mol of silver in the surface tatent image type silver halide emulsion is practically useful. practically useful.

The photographic emulsion used in the present invention may be spectrally sensitized with methine dyes and others. The dyes used include cyanine dyes, merocyanine dyes, composite cyanine dyes, composite merocyanine dyes, holopolar cyanine dyes, hemicyanine dyes, styryl dyes and hemioxonol dyes. Especially useful dyes are those which belong to cyanine dyes, merocyanine dyes and composite merocyanine dyes. These sensitizing dyes may be used alone or in combination. The combination of dyes is often employed especially for the purpose of supersensitization. The emulsion may contain, together with the sensitizing dye, a dye which per se has no spectral sensitizing action or a substance which does not substantially absorb visible light and shows supersensitization.

The water soluble polymer having an amino group other than primary amino group used in the present invention is a polymer containing a secondary or tertiary amine. Preferable examples of the polymer are those which are represented by the following formula.

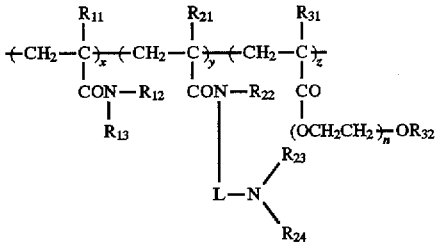

wherein $R_{11}$, $R_{12}$, $R_{13}$, $R_{21}$, $R_{22}$, $R_{23}$, $R_{24}$, $R_{31}$ and $R_{32}$ each represent a hydrogen atom or a substituted or unsubstituted alkyl group, and $R_{12}$ and $R_{13}$ and $R_{23}$ and $R_{24}$ may be the same or different and furthermore may link to each other to form a ring, respectively, but $R_{23}$ and $R_{24}$ cannot be simultaneously hydrogen atom, and L represents a substituted or unsubstituted divalent linkage group.

$R_{11}$, $R_{12}$, $R_{22}$, $R_{31}$ and $R_{32}$ are preferably hydrogen atom or lower alkyl groups such as methyl group and ethyl group and especially preferably hydrogen atom and methyl group. $R_{13}$, $R_{21}$, $R_{23}$ and $R_{24}$ are preferably hydrogen atom, methyl group, ethyl group, propyl group, isopropyl group, butyl group, 2-ethylhexyl group, methoxyethyl group and ethoxyethyl group and L is preferably ethylene group, propylene group, isopropylene group and butylene group. x, y and z show mol % and x is 20–99 mol %, preferably 50–95 mol %, y is 1–50 mol %, preferably 5–40 mol %, and z is 0–50 mol %, preferably 0–30 mol %. n is 3–50, preferably 3–30. Nonlimiting examples of the compounds represented by the above formula are enumerated below.

P-1

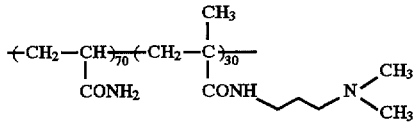

P-2

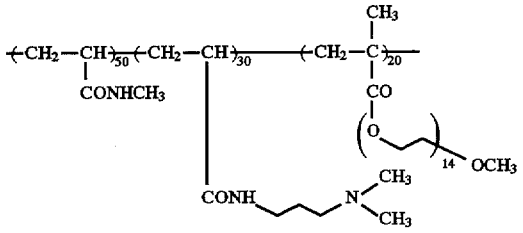

P-3

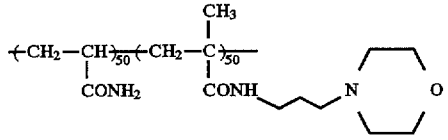

-continued

P-4

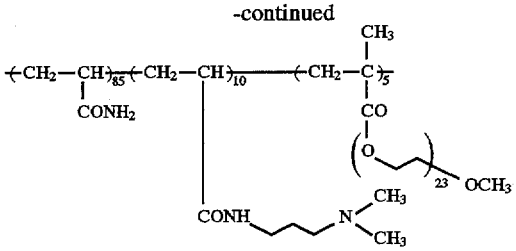

P-5

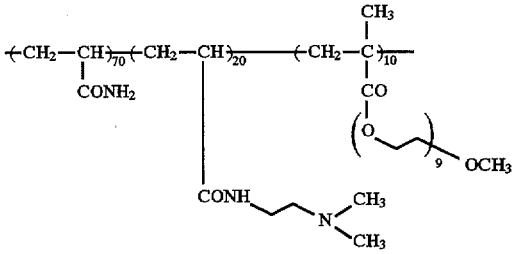

P-6

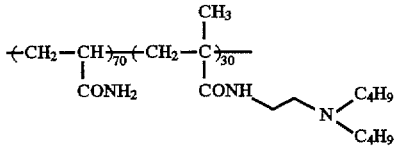

P-7

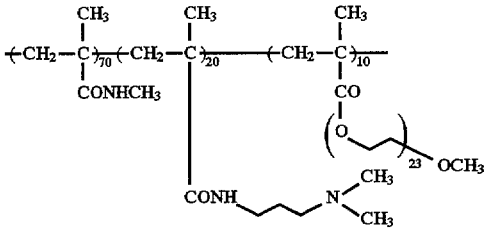

P-8

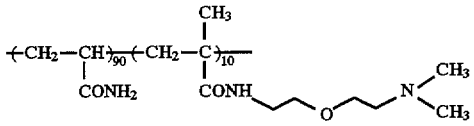

P-9

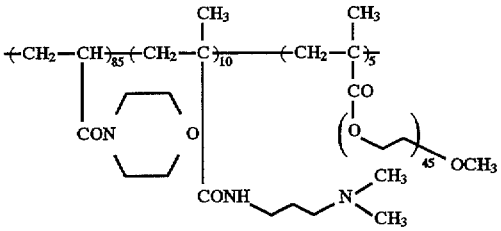

P-10

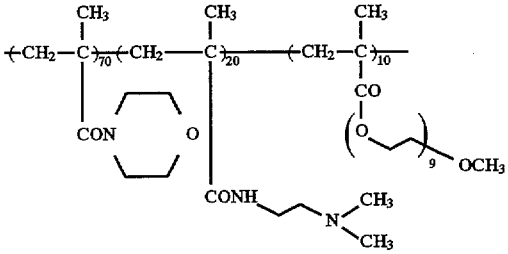

P-11

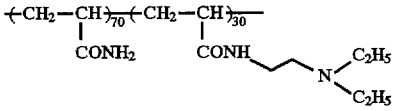

-continued

P-12

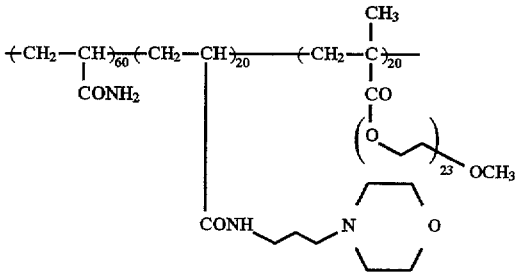

P-13

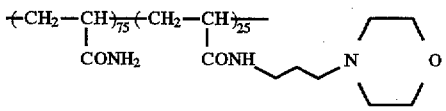

P-14

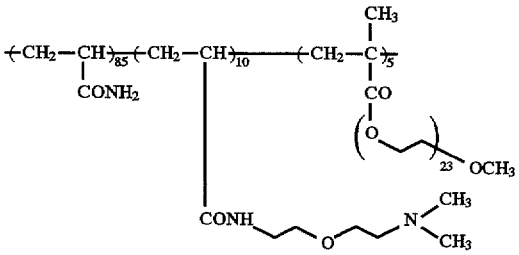

P-15

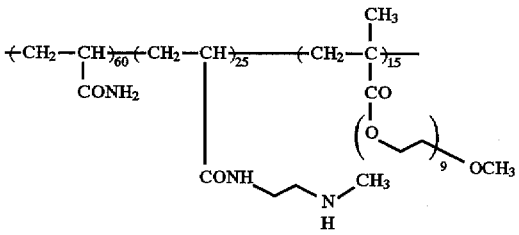

P-16

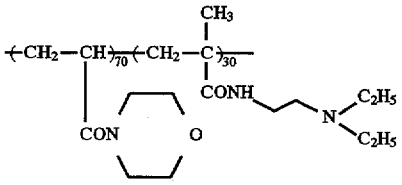

Furthermore, it has been found that the effect of the present invention can further been conspicuously exhibited by using a polisher represented by the following formula (1) as the water-soluble polymer containing an amino group exclusive of primary amino group. As compared with the polymer represented by the above formula, the polymer represented by the formula (1) can more highly enhance the contrast when it is contained in the silver halide photosensitive material and in addition, causes occurrence of neither fog nor adverse effect on the photosensitive characteristics even after a long-term storage of the photosensitive material.

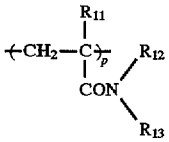

(1)

-continued

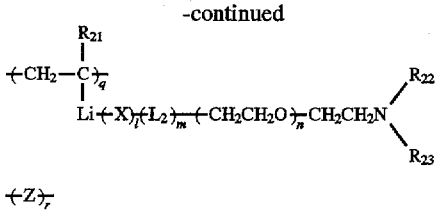

wherein $R_{11}$, $R_{12}$, $R_{13}$, $R_{21}$, $R_{22}$ and $R_{23}$ each represents a hydrogen atom or a substituted or unsubstituted alkyl group, $R_{12}$ and $R_{13}$ and $R_{22}$ and $R_{23}$ may be the same or different and may form a ring together, respectively, $R_{22}$ and $R_{23}$ cannot be simultaneously hydrogen atom, $L_1$ and $L_2$ each represent a linkage group represented by the following formulas (wherein $R_{31}$ and $R_{41}$ each represent a lower alkyl group or an alkoxy group and x and y each represent an integer of 0–4), X represents a substituted or unsubstituted alkylene group, 1 and m each represents or 1, n represents an integer of 2–30, Z represents a residue of an ethylenically unsaturated monomer, and p, q and r each represents wt %, and p is 0–95 wt %, q is 5–100 wt % and r is 0–50 wt %.

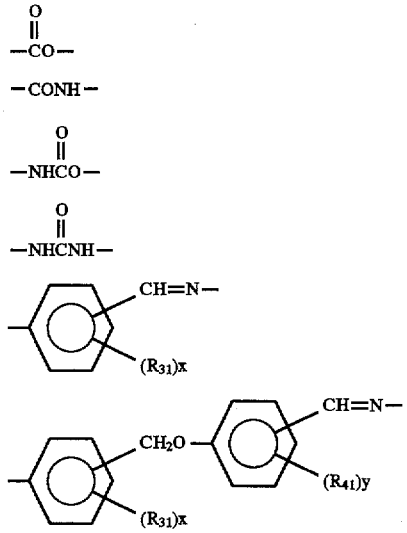

The formula (1) will be explained specifically.

$R_{11}$, $R_{12}$, $R_{13}$, $R_{21}$, $R_{22}$ and $R_{23}$ are preferably hydrogen atom, methyl group, ethyl group, propyl group and butyl group. $L_1$ and $L_2$ are linkage groups represented by the above formulas and X is preferably ethylene group, propylene group, isopropylene group and butylene group. $R_{31}$ and $R_{41}$ are preferably methyl group, ethyl group, propyl group, methoxy group and ethoxy group. 1 and m are 0 or 1 and n is 2–30. Z is a residue of an ethylenically unsaturated monomer and examples of the monomer are generally used ones such as acrylonitrile, (meth)acrylic acid alkyl esters ($C_1$–$C_{20}$), benzyl (meth)acrylate, hydroxyethyl (meth) acrylate, hydroxypropyl (meth)acrylate, dimethylaminoethyl (meth)acrylate, diethylaminoethyl (meth)acrylate, acryloylmorpholine, crotonic acid, itaconic acid, (meth) acrylic acid, styrene, sodium styrenesulfonate, vinylimidazole, maleic anhydride and N-vinylpyrrolidone and derivatives thereof.

Of the recurring units shown in the formula (1), as examples of the monomer represented by

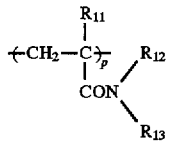

, mention may be made of acylamide, methacrylamide, N-methylacrylamide, N,N-dimethylacylamide, N-isopropylacrylamide, N-t-butylacrylamide, N,N-dimethylaminopropylacrylamide, N-acryloylmorpholine, N,N-diethylacrylamide, N-methylolacrylamide and N,N-dibutylaminoethylacrylamide. These monomers may be used each alone or in admixture.

Of the recurring units shown in the formula (1), as examples of the monomer represented by

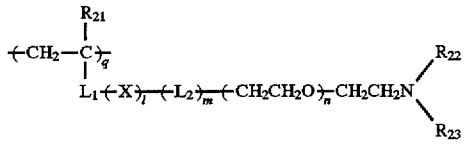

, mention may be made of those which are represented by the following formulas.

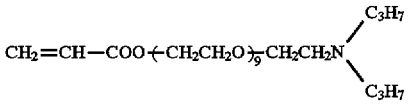

M-1

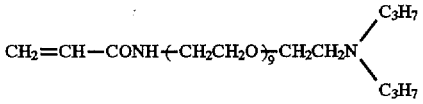

M-2

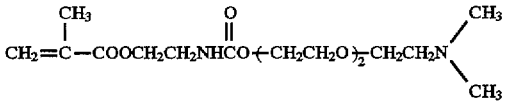

M-3

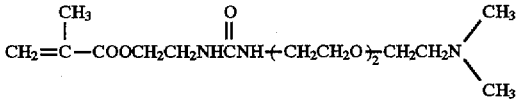

M-4

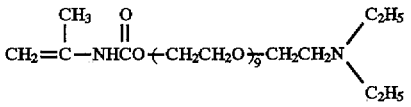

M-5

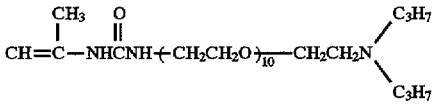

M-6

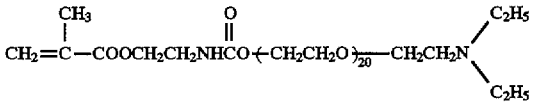

M-7

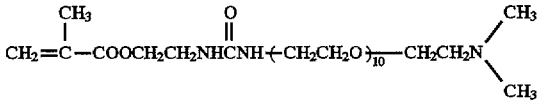

M-8

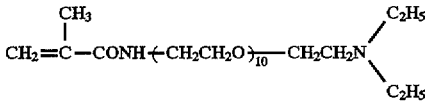

M-9

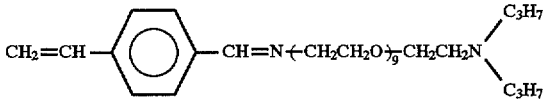

M-10

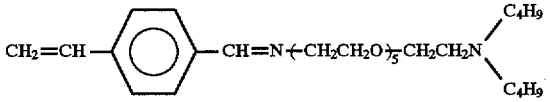

M-11

-continued

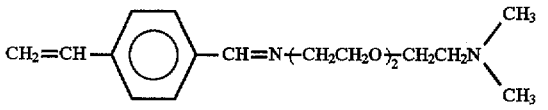

M-12

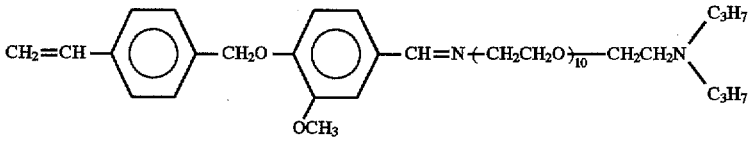

M-13

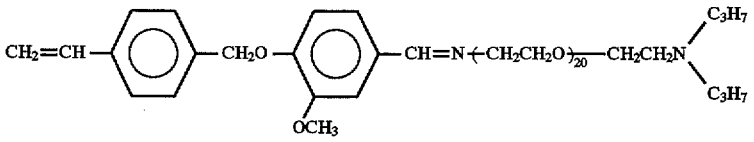

M-14

As for the proportion of these monomers in the copolymer composition, q in the recurring unit of the above formula is 5–100 wt %, more preferably 20–100 wt %. When this proportion decreases, the effect to enhance the contrast is small and the amount of the polymer necessary to attain sufficient promotion of enhancement of contrast becomes too much and this is not preferred. Moreover, p in another monomer used to be copolymerized with the above monomer is 0–95 wt % and preferably 80 wt % or less. In this case, the action to promote enhancement of contrast is not damaged by the copolymerization of the monomers and compatibility with gelatin or film properties are improved. Further, r for Z in the formula (1) is 0–50 wt % and the monomer can be added for adjustment of viscosity and hydrophobic property and addition of it in an amount exceeding the above range is not preferred because the action to promote the enhancement of contrast is reduced.

The water-soluble polymer having an amino group used in the present invention can be prepared, for example, by customary process of vinyl polymerization. That is, the polymer can be obtained by adding a polymerization initiator to a solution of a mixture of two or three vinyl monomers and heating the mixture in a nitrogen atmosphere or keeping a solution containing a polymerization initiator at a high temperature and adding thereto dropwise a monomer mixture. Solvents used for the polymerization include, for example, water, methanol, ethanol, DMF, DMSO and dioxane, and water is preferred. These solvents can also be used in admixture. As the polymerization initiator, there may be used those which are well known, for example, peroxides such as potassium persulfate, benzoyl peroxide and cumene hydroperoxide and azo type polymerization initiators such as azobisisobutyronitrile and 2,2'-azobis(2-amidinopropane) dihydrochloride. The average molecular weight of the polymer used in the present invention is about 1000–200,000, preferably about 5000–100,000. By using the polymer having a molecular weight in this range, the polymer having amino group introduced into the photosensitive material is satisfactorily fixed in the film and there can be exhibited the preferable effect that it does not bleed out to the surface of the photosensitive material during storage and thus, the photosensitive material is superior in storage stability.

Nonlimiting typical examples of the polymer are exemplified below.

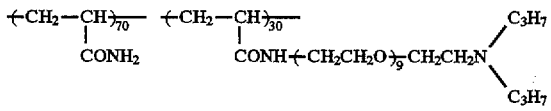

P-17

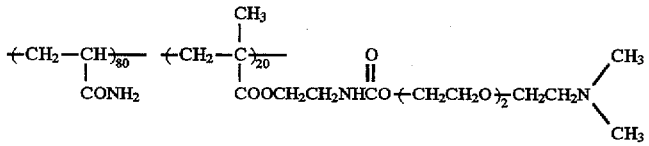

P-18

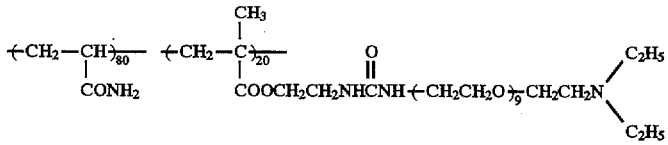

P-19

-continued

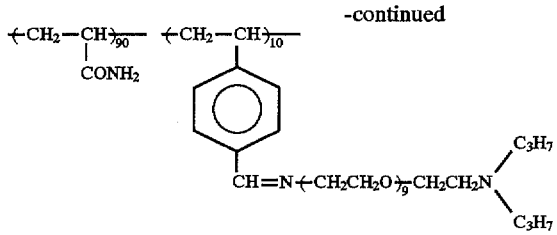

P-20

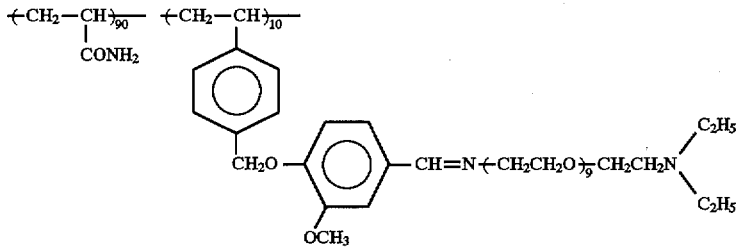

P-21

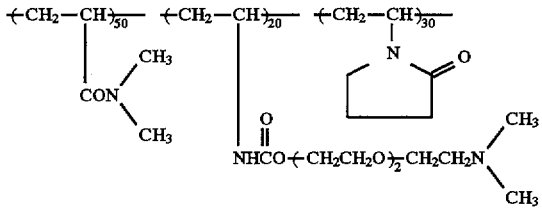

P-22

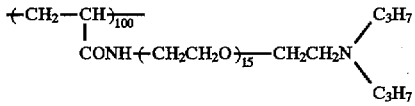

P-23

Preparation examples of the polymer represented by the formula (1) are shown below.

Preparation Example 1 (Preparation of Polymer P-17)

3 g of a hydrochloride of the above-exemplified monomer M-2 (obtained from 11 g of dipropylaminoethylnonaethylene oxide amine and 2 g of acryloyl chloride) and 7 g of acrylamide were dissolved in 30 ml of water and 30 ml of ethanol, and to the solution was added 50 mg of 2,2'-azobis (2-amidinopropane) dihydrochloride, followed by stirring at 65° C. for 3 hours in a nitrogen stream to obtain a viscous polymer solution. Measurement by GPC gave a weight-average molecular weight of about 20,000.

Preparation Example 2 (Preparation of Poller P-18)

2 g of the monomer M-3 (obtained from 9 g of dimethylaminoethyldiethylene glycol and 8 g of methacryloxyethyl isocyanate) and 8 g of acrylamide were dissolved in 30 ml of water and the solution was neutralized with dilute hyrochloric acid. Thereto was added 25 ml of ethanol and polymerization was effected in the same manner using the same polymerization initiator as in Preparation Example 1. The weight-average molecular weight was about 30,000.

When the compound of the formula (1) is contained in the photographic photosensitive material, it is preferably contained in the silver halide emulsion layer, but it may be contained in other non-photosensitive hydrophilic colloid layers such as protective layer, intermediate layer, filter layer and antihalation layer. In case the compound is contained in the silver halide emulsion layer, it can be added at an optional time in preparation of the emulsion, but preferably it is added during the period after completion of chemical ripening and until the coating. Especially preferably, it is added to the coating solution prepared for coating. The amount of the compound is preferably 0.01–2 g/m$^2$. When the compound is added to developer, the action to promote the enhancement of contrast can be seen, but in this case, preferably it is added in an amount of 1–100 g for 1 liter of the developer. The compound of the formula (1) has the effect to promote the enhancement of contrast in the system of producing so-called high contrast silver image. The compound of the formula (1) exhibits the highest effect in the system in which hydrazine compounds are used as nucleating agent.

As binders or protective colloids usable in the emulsion layer or intermediate layer of the photosensitive materials of the present invention, use of gelatin is advantageous, but other hydrophilic colloids can also be used. For example, there may be used gelatin derivatives, graft polymers of gelatin with other polymers, proteins such as albumin and casein, cellulose derivatives such as hydroxyethyl cellulose, carboxymethyl cellulose and cellulose sulfate, sugar derivatives such as sodium alginate and starch derivatives, and various synthetic hydrophilic polymeric materials such as polyvinyl alcohol, partial acetal of polyvinyl alcohol, poly-N-vinylpyrrolidone, polyacrylic acid, polymethacrylic acid, polyacrylamide and polyvinyl imidazole which are used singly or as copolymers. As the gelatins, there may be used acid-treated gelatins and enzyme-treated gelatins described in Bull. Soc. Sci. Phot. Japan, No.16, p30 (1966) as well as lime-treated gelatins, and besides, hydrolyzates or enzyme-decomposed products of gelatin can also be used.

In order that handling under roomlight is made possible in the method of forming high contrast images using hydrazine compounds, the conventional safelight dyes may be contained in the emulsion layer or other hydrophilic colloid layers. Various compounds can be contained in the photographic emulsion used in the present invention for the purposes of preventing occurrence of fog during preparation, storage or photographic processing of the photosensitive materials or stabilization of photographic performance. Examples of the compounds are conventionally known antifoggants and stabilizers, for example, azoles such as benzothiazolium salts, nitroimidazoles, nitrobenzimidazoles, chlorobenzimidazoles, mercaptothiazoles, mercaptobenzothiazoles, mercaptothiadiazoles, aminotriazoles, benzotriazoles and mercaptotetrazoles; mercaptopyrimidines, mercaptotriazines, thioketo compounds; azaindenes. Of these compounds, especially preferred are benzotriazoles such as 5-methylbenzotriazoles and nitroindazoles such as 5-nitroindazole. These compounds may be contained in the processing solution.

The photographic photosensitive material of the present invention may contain inorganic or organic hardeners in the photographic emulsion layer and other hydrophilic colloid layers. For example, chromium salts (such as chrome alum), aldehydes (such as formaldehyde and glyoxal), N-methylol compounds, dioxane derivatives (such as 2,3-dihydroxydioxane), active vinyl compounds, and active halogen compounds (such as 2,4-dichloro-6-hydroxy-S-triazine) may be used each alone or in combination.

The photographic emulsion layer or other hydrophilic colloid layers of the photosensitive materials may contain surface active agents for various purposes such as coating aid, antistatic purpose, improvement of slippage, emulsification dispersion, inhibition of adhesion and improvement of photographic characteristics (such as acceleration of development, enhancement of contrast and sensitization). For example, there may be used nonionic surface active agents such as saponins (steroid type), alkylene oxide derivatives (such as polyethylene glycol and polyethylene glycol alkyl ethers), glycidol derivatives (such as polyglyceride alkenylsuccinate), fatty acid esters of polyhydric alcohols and alkyl esters of sugars, anionic surface active agents containing acidic groups such as carboxy group, sulfo group, phospho group, sulfate ester group and phosphate ester group, for example, alkylcarboxylates, alkylsulfates and alkylphosphates, amphoteric surface active agents such as amino acids, aminoalkylsulfonic acids and aminoalkylsulfates or aminoalkylphosphate esters, and cationic surface active agents such as aliphatic or aromatic quaternary ammonium salts and heterocyclic quaternary ammonium salts such as pyridinium and imidazolium.

The photographic photosensitive material of the present invention can contain water-insoluble or slightly water-soluble synthetic polymer decomposed products in the photographic emulsion layer or other hydrophilic colloid layers for the purpose of improvement of dimensional stability. Examples of the polymers are those which contain as monomer components one or more of alkyl (meth)acrylates, alkoxyalkyl (meth)acrylates, glycidyl (meth)acrylates, (meth)acrylamides, vinyl acetate, acrylonitrile, olefins and styrene or combination of these monomers with acrylic acid, methacrylic acid, α,β-unsaturated dicarboxylic acid, hydroxyalkyl (meth)acrylates or styrenesulfonic acid.

In order to obtain photographic characteristics of high contrast using the silver halide photosensitive materials of the present invention, there is no need to use the conventional lith developers or the high alkali developers having a pH close to 13 described in U.S. Pat. No. 2,419,975 and stable developers can be used. That is, for processing of the silver halide photographic photosensitive materials of the present invention, developers which contain sulfite ion as a preservative in a sufficient amount (especially, more than 0.15 mol/l) can be used, and negative images of sufficiently superhigh contrast can be obtained with developers having a pH of 9.5 or more, especially 10–11.5.

The following nonlimiting examples explain the present invention.

EXAMPLE 1

1 g/l mol Ag of 6-methyl-4-hydroxy-1,3,3a,7-tetrazaindene was added to a monodispersed silver chlorobromide emulsion containing iridium, having an average grain size of 0.25 μm and prepared by the controlled double jet method. To the emulsion were added 300 mg/l mol Ag of anhydro-5,5'-dichloro-9-ethyl-3,3'-di-(3-sulfopropyl) oxacarbocyanine hydroxide pyridinium as a sensitizing dye, 250 mg/l mol Ag of polyethylene glycol, a hydrazine compound exemplified hereinbefore in an amount as shown in Table 1 and a water-soluble polymer having amino group as a promoter for enhancement of contrast in an amount as shown in Table 1. To the resulting emulsion were added 2 g/m$^2$ of a dispersion of polyethylene acrylate and 2.5 g/m$^2$ of gelatin, and the emulsion was coated on a polyethylene terephthalate film at a coating amount of 3.5 g/m$^2$ in terms of silver and at the same time, 1.0 g/m$^2$ of gelatin was coated as a protective layer on the emulsion layer. As comparative promoters for enhancement of contrast, the following comparative compounds (1), (2) and (3) were similarly used.

Comparative Compound (1)

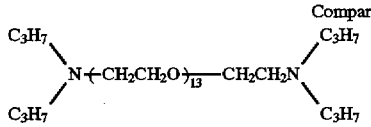

Comparative Compound (2)

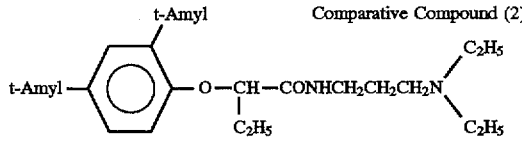

Comparative Compound (3)

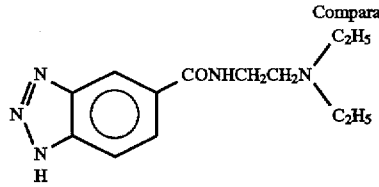

The thus obtained samples were exposed through an optical wedge in a printer using a tungsten lamp as a light source and then, developed with a developer having the following composition at 38° C. for 20 seconds, stopped, fixed, washed with water and dried. Relative photographic sensitivity and contrast (optical density 0.1–2.50) of the samples were evaluated. The contrast was expressed by the slope of straight line portion of characteristic curve (tan 8 of optical density of 0.1–2.50) and density of the shoulder portion on the characteristic curve was obtained. Dot quality was determined by subjective measure and ranked by the five grades with 1 being extremely bad and 5 being very good. Grades of 3 or higher were practically acceptable. The results are shown in Table 2.

| <Developer (concentrated)> | |
|---|---|
| Hydroquinone | 65 g |
| 4-Hydroxymethyl-4-methyl-1-phenyl-3-pyrazolidone | 2.9 g |
| Sodium pyrosulfite | 145 g |
| Pentasodium diethylenetriamine-pentaacetate | 6.0 g |
| Boric acid | 6.9 g |
| Sodium bromide | 12 g |
| 1-Phenyl-5-mercaptotetrazole | 0.05 g |
| Sodium hydroxide | 23 g |
| Benzotriazole | 0.4 g |
| Potassium hydroxide | 80 g |
| Potassium carbonate | 80 g |
| Diethylene glycol | 120 g |
| Water to make up 1 liter. | |

The above concentrated developer was diluted with water in an amount of 4 parts per 1 part of the developer to prepare a developer having a pH of 10.4.

TABLE 1

| Sample No. | Hydrazine compound Kind | Hydrazine compound Amount (mol/Ag 1 mol) | Promoter Kind | Promoter Amount ($g/m^2$) | Note |
|---|---|---|---|---|---|
| 1 | H-24 | $2 \times 10^{-5}$ | None | — | Comparative |
| 2 | " | " | Comparative Compound (2) | $2 \times 10^{-2}$ | " |
| 3 | " | " | Comparative Compound (2) | $4 \times 10^{-2}$ | " |
| 4 | " | " | Comparative Compound (3) | $2 \times 10^{-2}$ | " |
| 5 | " | " | Comparative Compound (3) | $4 \times 10^{-2}$ | " |
| 6 | H-25 | " | Comparative Compound (2) | $2 \times 10^{-2}$ | " |
| 7 | " | " | Comparative Compound (2) | $4 \times 10^{-2}$ | " |
| 8 | " | " | Comparative Compound (1) | $2 \times 10^{-2}$ | " |
| 9 | " | " | Comparative Compound (1) | $4 \times 10^{-2}$ | " |
| 10 | H-24 | " | P-1 | $3 \times 10^{-2}$ | The present invention |
| 11 | " | " | " | $7 \times 10^{-2}$ | The present invention |
| 12 | " | " | P-3 | $3 \times 10^{-2}$ | The present invention |
| 13 | " | " | " | $7 \times 10^{-2}$ | The present invention |
| 14 | H-25 | " | P-1 | $3 \times 10^{-2}$ | The present invention |
| 15 | " | " | " | $7 \times 10^{-2}$ | The present invention |
| 16 | " | " | P-4 | $4 \times 10^{-2}$ | The present invention |
| 17 | " | " | " | $8 \times 10^{-2}$ | The present invention |
| 18 | H-24 | " | P-5 | $5 \times 10^{-2}$ | The present invention |
| 19 | " | " | " | $10 \times 10^{-2}$ | The present invention |
| 20 | " | " | P-6 | $5 \times 10^{-2}$ | The present invention |
| 21 | " | " | " | $10 \times 10^{-2}$ | The present invention |

TABLE 2

| Sample No. | Sensitivity | Contrast | Density of shoulder portion | Dot quality |
|---|---|---|---|---|
| 1 | 100 | 2.1 | 1.4 | 1 |
| 2 | 103 | 3.3 | 2.3 | 1 |
| 3 | 105 | 3.8 | 2.7 | 2 |
| 4 | 104 | 4.1 | 2.9 | 2 |
| 5 | 108 | 4.9 | 3.2 | 3 |
| 6 | 102 | 3.2 | 2.2 | 1 |
| 7 | 106 | 3.6 | 2.7 | 2 |
| 8 | 104 | 3.7 | 2.9 | 2 |
| 9 | 107 | 4.8 | 3.2 | 3 |
| 10 | 104 | 6.7 | 3.7 | 3 |
| 11 | 105 | 8.9 | 3.9 | 3 |
| 12 | 106 | 6.9 | 3.8 | 4 |
| 13 | 105 | 9.0 | 4.1 | 4 |
| 14 | 104 | 8.5 | 4.0 | 4 |
| 15 | 106 | 9.9 | 4.3 | 4 |
| 16 | 101 | 10.1 | 3.8 | 3 |
| 17 | 102 | 10.5 | 4.4 | 4 |
| 18 | 103 | 9.7 | 3.5 | 3 |
| 19 | 105 | 11.6 | 4.6 | 4 |
| 20 | 106 | 10.2 | 3.9 | 4 |
| 21 | 105 | 13.2 | 4.5 | 4 |

EXAMPLE 2

Example 1 was repeated except that pH of the developer used in Example 1 was adjusted as shown in Table 3 with aqueous sodium hydroxide solution and sulfuric acid and the developing time was 1 minute at 35° C., and the samples were evaluated on the same items as in Example 1. Moreover, pepper fog was visually evaluated and ranked by the five grades of 1 being extremely bad and 5 being in good state where substantially no pepper fogs were recognized. The results are shown in Tables 3 and 4.

TABLE 3

| Sample No. | pH | Sensitivity | Contrast | Density of shoulder portion | Pepper fog | Dot quality | Note |
|---|---|---|---|---|---|---|---|
| 1 | 10.2 | 100 | 1.9 | 0.9 | 5 | 1 | Comparative |
| | 11.0 | 108 | 2.4 | 1.6 | 4 | 1 | " |
| 2 | 10.2 | 101 | 2.7 | 1.9 | 4 | 1 | " |
| | 11.0 | 114 | 3.7 | 2.9 | 3 | 1 | " |
| 3 | 10.2 | 103 | 3.0 | 2.5 | 4 | 2 | " |
| | 11.0 | 114 | 4.1 | 3.4 | 3 | 2 | " |
| 4 | 10.2 | 102 | 3.8 | 2.8 | 4 | 2 | " |
| | 11.0 | 110 | 4.4 | 3.5 | 3 | 2 | " |
| 5 | 10.2 | 106 | 4.3 | 2.9 | 3 | 2 | " |
| | 11.0 | 114 | 5.3 | 3.3 | 3 | 3 | " |
| 6 | 10.2 | 100 | 2.9 | 2.0 | 5 | 1 | " |
| | 11.0 | 105 | 3.5 | 3.1 | 4 | 2 | " |
| 7 | 10.2 | 104 | 3.3 | 2.1 | 4 | 1 | " |
| | 11.0 | 112 | 4.2 | 3.1 | 3 | 2 | " |
| 8 | 10.2 | 102 | 3.4 | 2.6 | 3 | 2 | " |
| | 11.0 | 111 | 4.2 | 3.5 | 2 | 2 | " |
| 9 | 10.2 | 105 | 4.4 | 2.9 | 2 | 2 | " |
| | 11.0 | 112 | 4.9 | 3.8 | 2 | 1 | " |

TABLE 4

| Sample No. | pH | Sensitivity | Contrast | Density of shoulder portion | Pepper fog | Dot quality | Note |
|---|---|---|---|---|---|---|---|
| 10 | 10.2 | 103 | 6.2 | 3.5 | 4 | 3 | The present invention |
| | 11.0 | 105 | 7.3 | 3.9 | 4 | 3 | The present |

TABLE 4-continued

| Sample No. | pH | Sensitivity | Contrast | Density of shoulder portion | Pepper fog | Dot quality | Note |
|---|---|---|---|---|---|---|---|
| | | | | | | | invention |
| 11 | 10.2 | 104 | 8.5 | 3.8 | 4 | 3 | The present invention |
| | 11.0 | 106 | 9.0 | 4.1 | 4 | 4 | The present invention |
| 12 | 10.2 | 104 | 6.7 | 3.7 | 4 | 3 | The present invention |
| | 11.0 | 107 | 7.1 | 4.1 | 4 | 4 | The present invention |
| 13 | 10.2 | 104 | 8.7 | 3.8 | 4 | 3 | The present invention |
| | 11.0 | 108 | 9.2 | 4.2 | 4 | 4 | The present invention |
| 14 | 10.2 | 102 | 8.1 | 3.8 | 4 | 3 | The present invention |
| | 11.0 | 106 | 8.6 | 4.0 | 4 | 4 | The present invention |
| 15 | 10.2 | 105 | 9.5 | 4.1 | 4 | 4 | The present invention |
| | 11.0 | 107 | 10.2 | 4.4 | 3 | 4 | The present invention |
| 16 | 10.2 | 100 | 9.8 | 3.7 | 4 | 3 | The present invention |
| | 11.0 | 102 | 10.4 | 4.1 | 3 | 4 | The present invention |
| 17 | 10.2 | 101 | 10.2 | 4.2 | 4 | 3 | The present invention |
| | 11.0 | 103 | 10.6 | 4.5 | 4 | 4 | The present invention |
| 18 | 10.2 | 102 | 9.4 | 3.3 | 4 | 3 | The present invention |
| | 11.0 | 104 | 10.2 | 3.7 | 4 | 4 | The present invention |
| 19 | 10.2 | 104 | 11.2 | 4.3 | 4 | 4 | The present invention |
| | 11.0 | 107 | 11.8 | 4.9 | 3 | 4 | The present invention |
| 20 | 10.2 | 104 | 10.0 | 3.8 | 4 | 3 | The present invention |
| | 11.0 | 107 | 10.4 | 4.3 | 3 | 4 | The present invention |
| 21 | 10.2 | 104 | 12.8 | 4.3 | 4 | 3 | The present invention |
| | 11.0 | 106 | 13.4 | 4.7 | 4 | 4 | The present invention |

EXAMPLE 3

In the same manner as in Example 1, the water-soluble polymer having amino group and the hydrazine compound were added to the emulsion at the composition as shown in Table 5 and the emulsion was coated, exposed and developed (using the same developer as shown in Example 1). The results as shown in Table 6 were obtained.

TABLE 5

| Sample No. | Hydrazine compound Kind | Hydrazine compound Amount (mol/Ag 1 mol) | Promoter Kind | Promoter Amount ($g/m^2$) | Note |
|---|---|---|---|---|---|
| 1 | H-1 | $7 \times 10^{-4}$ | None | — | Comparative |
| 2 | " | " | Comparative Compound (1) | $1 \times 10^{-2}$ | " |
| 3 | " | " | Comparative Compound (1) | $2 \times 10^{-2}$ | " |
| 4 | " | " | Comparative Compound (2) | $1 \times 10^{-2}$ | " |
| 5 | " | " | Comparative Compound (2) | $2 \times 10^{-2}$ | " |
| 6 | " | " | Comparative Compound (3) | $1 \times 10^{-2}$ | " |
| 7 | " | " | Comparative Compound (3) | $2 \times 10^{-2}$ | " |
| 8 | " | " | P-17 | $2 \times 10^{-2}$ | The present invention |
| 9 | " | " | " | $5 \times 10^{-2}$ | The present invention |
| 10 | " | " | P-18 | $2 \times 10^{-2}$ | The present invention |
| 11 | " | " | " | $5 \times 10^{-2}$ | The present invention |
| 12 | " | " | P-19 | $2 \times 10^{-2}$ | The present invention |
| 13 | " | " | " | $5 \times 10^{-2}$ | The present invention |
| 14 | H-3 | " | Comparative Compound (1) | $1 \times 10^{-2}$ | Comparative |
| 15 | " | " | Comparative Compound (1) | $2 \times 10^{-2}$ | " |
| 16 | " | " | Comparative Compound (3) | $1 \times 10^{-2}$ | " |
| 17 | " | " | Comparative Compound (3) | $2 \times 10^{-2}$ | " |
| 18 | " | " | P-17 | $2 \times 10^{-2}$ | The present invention |
| 19 | " | " | " | $5 \times 10^{-2}$ | The present invention |
| 20 | " | " | P-18 | $2 \times 10^{-2}$ | The present invention |
| 21 | " | " | " | $5 \times 10^{-2}$ | The present invention |
| 22 | " | " | P-21 | $2 \times 10^{-2}$ | The present invention |
| 23 | " | " | " | $5 \times 10^{-2}$ | The present invention |

TABLE 6

| Sample No. | Sensitivity | Contrast | Dot quality | Pepper fog | Note |
|---|---|---|---|---|---|
| 1 | 100 | 3.7 | 1 | 5 | Comparative |
| 2 | 120 | 13.6 | 2 | 2 | " |
| 3 | 122 | 15.9 | 3 | 1 | " |
| 4 | 101 | 3.6 | 1 | 4 | " |
| 5 | 102 | 3.7 | 1 | 3 | " |
| 6 | 105 | 4.1 | 1 | 4 | " |
| 7 | 105 | 5.5 | 2 | 3 | " |
| 8 | 112 | 13.7 | 3 | 4 | The present invention |
| 9 | 114 | 14.6 | 4 | 4 | The present invention |
| 10 | 120 | 12.4 | 3 | 4 | The present invention |
| 11 | 122 | 13.8 | 3 | 3 | The present invention |
| 12 | 119 | 13.0 | 3 | 4 | The present invention |
| 13 | 123 | 13.9 | 4 | 4 | The present invention |
| 14 | 121 | 14.4 | 2 | 2 | Comparative |
| 15 | 126 | 15.0 | 3 | 1 | " |
| 16 | 108 | 4.6 | 1 | 3 | " |
| 17 | 108 | 5.2 | 2 | 3 | " |

TABLE 6-continued

| Sample No. | Sensitivity | Contrast | Dot quality | Pepper fog | Note |
|---|---|---|---|---|---|
| 18 | 120 | 14.0 | 4 | 4 | The present invention |
| 19 | 122 | 14.8 | 4 | 3 | The present invention |
| 20 | 125 | 13.1 | 3 | 4 | The present invention |
| 21 | 129 | 14.7 | 4 | 3 | The present invention |
| 22 | 122 | 14.2 | 3 | 4 | The present invention |
| 23 | 123 | 14.3 | 3 | 4 | The present invention |

EXAMPLE 4

The hydrazine compound and the promoter for enhancement of contrast exemplified hereinbefore were added, as shown in Table 7, to the emulsion prepared by the controlled double jet method in the same manner as in Example 2. In the same manner as in Example 2, 5-chlorobenzotriazole, ethyl polyacrylate latex and 2-hydroxy-4,6-dichloro-1,3,5-triazine sodium salt were added and the emulsion was coated on a polyethylene terephthalate film. Thereon was formed the same layer as in Example 2 as a protective layer to prepare the samples as shown in Table 7. The same comparative promoter compounds as in Example 1 were used to prepare comparative samples.

The samples were exposed imagewise by a roomlight printer and then developed with the same developer as used in Example 1, stopped, fixed, washed with water and dried by an automatic processor (LD-221QT). The samples were evaluated on the same items as in Example 1 to obtain the results as shown in Table 8.

TABLE 7

| Sample No. | Hydrazine compound Kind | Hydrazine compound Amount (mol/Ag 1 mol) | Promoter Kind | Promoter Amount ($g/m^2$) | Note |
|---|---|---|---|---|---|
| 1 | H-3 | $1 \times 10^{-3}$ | None | — | Comparative |
| 2 | " | " | Comparative Compound (1) | $2 \times 10^{-2}$ | " |
| 3 | " | " | Comparative Compound (1) | $4 \times 10^{-2}$ | " |
| 4 | " | " | Comparative Compound (2) | $2 \times 10^{-2}$ | " |
| 5 | " | " | Comparative Compound (2) | $4 \times 10^{-2}$ | " |
| 6 | " | " | Comparative Compound (3) | $2 \times 10^{-2}$ | " |
| 7 | " | " | Comparative Compound (3) | $4 \times 10^{-2}$ | " |
| 8 | " | " | P-17 | $4 \times 10^{-2}$ | The present invention |
| 9 | " | " | " | $8 \times 10^{-2}$ | The present invention |
| 10 | " | " | P-18 | $4 \times 10^{-2}$ | The present invention |
| 11 | " | " | " | $8 \times 10^{-2}$ | The present invention |
| 12 | " | " | P-19 | $4 \times 10^{-2}$ | The present invention |
| 13 | " | " | " | $8 \times 10^{-2}$ | The present invention |
| 14 | H-12 | " | Comparative Compound (1) | $2 \times 10^{-2}$ | Comparative |
| 15 | " | " | Comparative Compound (1) | $4 \times 10^{-2}$ | " |
| 16 | " | " | Comparative Compound (3) | $2 \times 10^{-2}$ | " |
| 17 | " | " | Comparative Compound (3) | $4 \times 10^{-2}$ | " |
| 18 | " | " | P-17 | $4 \times 10^{-2}$ | The present invention |
| 19 | " | " | " | $8 \times 10^{-2}$ | The present invention |
| 20 | " | " | P-18 | $4 \times 10^{-2}$ | The present invention |
| 21 | " | " | " | $8 \times 10^{-2}$ | The present invention |
| 22 | " | " | P-21 | $4 \times 10^{-2}$ | The present invention |
| 23 | " | " | " | $8 \times 10^{-2}$ | The present invention |

TABLE 8

| Sample No. | Sensitivity | Contrast | Dot quality | Pepper fog | Note |
|---|---|---|---|---|---|
| 1 | 100 | 5.7 | 1 | 5 | Comparative |
| 2 | 119 | 13.6 | 2 | 3 | " |
| 3 | 118 | 15.9 | 2 | 2 | " |
| 4 | 101 | 5.6 | 1 | 4 | " |
| 5 | 101 | 5.7 | 1 | 3 | " |
| 6 | 104 | 6.1 | 1 | 4 | " |
| 7 | 106 | 6.5 | 2 | 3 | " |
| 8 | 114 | 14.9 | 4 | 5 | The present invention |
| 9 | 118 | 16.0 | 4 | 4 | The present invention |
| 10 | 121 | 16.3 | 3 | 4 | The present invention |
| 11 | 121 | 16.8 | 4 | 4 | The present invention |
| 12 | 120 | 16.6 | 3 | 5 | The present invention |
| 13 | 123 | 16.9 | 4 | 4 | The present invention |
| 14 | 120 | 14.4 | 3 | 3 | Comparative |
| 15 | 124 | 16.0 | 3 | 2 | " |
| 16 | 107 | 6.6 | 1 | 3 | " |
| 17 | 108 | 6.7 | 2 | 3 | " |
| 18 | 118 | 15.0 | 3 | 4 | The present invention |
| 19 | 124 | 16.2 | 4 | 4 | The present invention |
| 20 | 124 | 15.5 | 4 | 5 | The present invention |
| 21 | 127 | 15.9 | 4 | 4 | The present invention |
| 22 | 125 | 14.8 | 3 | 5 | The present invention |
| 23 | 124 | 15.3 | 4 | 4 | The present invention |

It can be seen that the sensitivity, contrast and density of the shoulder portion are considerably increased and the dot quality is improved by use of the hydrazine compound and the water-soluble polymer having an amino group other than primary amino group in combination. Furthermore, even when pH of the developer changes, the characteristics hardly change as compared with those of the comparative samples and in addition, generation of pepper fogs is prevented and practically preferable photographic characteristics can be obtained. Moreover, it is clear that when the polymer of the present invention is used, enhancement of contrast due to hydrazine compounds occurs even using a developer of low pH value. It can be further seen that when the polymer of the formula (1) is used, the stronger action to-promote the enhancement of contrast is exhibited and the sensitivity, contrast and dot quality are improved.

As explained above, according to the present invention, using the silver halide photogrpahic photosensitive material containing a hydrazine compound and the water-soluble polymer having an amino group other than primary amino group, there can be obtained high contrast images without the necessity of using amino compounds in the developer and with being hardly affected by the change in pH caused by a long run. Furthermore, the polymers having an amino group used in the present invention are easy in synthesis and low in cost and are very effective. Moreover, the formation of high contrast images using the silver halide photographic materials containing hydrazine compounds together with the polymer of the formula (1) as a promoter for enhancement of contrast can be performed even with a developer of low pH value as compared with prior art and practically preferable photographic characteristics are given with inhibiting occurrence of pepper fogs.

What is claimed is:

1. A silver halide photographic photosensitive material which comprises;

a support, at least one hydrophilic colloid layer which is a silver halide emulsion layer, and at least one additional hydrophilic colloid layer, which is not a silver halide emulsion layer, a hydrazine compound being contained in said at least one silver halide layer or said at least one additional hydrophilic colloid layer, wherein the same or different at least one silver halide layer or at least one additional hydrophilic colloid layer contains a water-soluble vinyl polymer having an amino group exclusive of a primary amino group as a promoter for contrast enhancement by the hydrazine compound represented by the following formula (1):

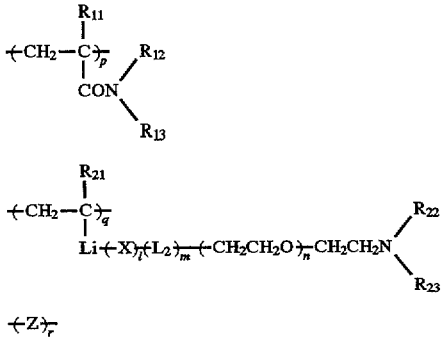

(1)

wherein $R_{11}$, $R_{12}$, $R_{13}$, $R_{21}$, $R_{22}$ and $R_{23}$ each represents an hydrogen atom or an alkyl group, $R_{12}$ and $R_{13}$ may be the same or different and may form a ring together, $R_{22}$ and $R_{23}$ may be the same or different and may form a ring together, $R_{22}$ and $R_{23}$ cannot be simultaneously hydrogen atom, X represents an alkylene group, 1 and m each represent 0 or 1, n represents an integer of 2–30, Z represents a residue of an ethylenically unsaturated monomer, and p, q and r each represent wt %, and p is 0–95 wt %, q is 5–100 wt % and r is 0–50 wt %, $L_1$ and $L_2$ each represent a linkage group selected from the group consisting of the following,

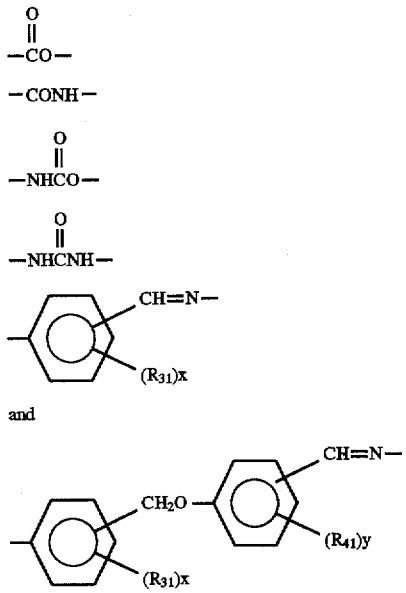

wherein $R_{31}$ and $R_{41}$ each represent a lower alkyl group or an alkoxy group and x and y each represent an integer of 0–4.

2. A silver halide photographic photosensitive material which comprises a support, at least one hydrophilic colloid layer which is a silver halide emulsion layer, and at least one additional hydrophilic colloid layer which is not a silver halide emulsion layer, a hydrazine compound being contained in said at least one silver halide layer or said at least one additional hydrophilic colloid layer, wherein the same or different at least one silver halide layer or at least one additional hydrophilic colloid layer contains a water-soluble polymer according to, wherein the water-soluble polymer is represented by the following formula:

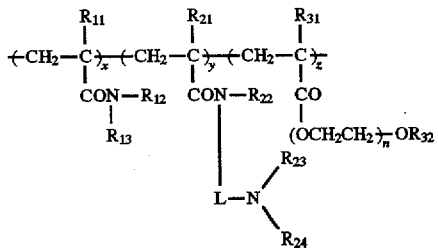

wherein $R_{11}$, $R_{12}$, $R_{13}$, $R_{21}$, $R_{22}$, $R_{23}$, $R_{24}$, $R_{31}$ and $R_{32}$ each represent a hydrogen atom or an alkyl group, and $R_{12}$ and $R_{13}$ may be the same or different and may link to each other to form a ring and $R_{23}$ and $R_{24}$ may be the same or different and may link to each other to form a ring with a proviso that $R_{23}$ and $R_{24}$ cannot be simultaneously hydrogen atom, L represents a divalent linkage group, x, y and z shows mol % add x is 20–99 mol %, y is 1–50 mol %, and z is 0–50 mol %, and n is 3–50.

3. A silver halide photographic photosensitive material according to claim 1, wherein amount of the water-soluble polymer is 0.01–2 g/m$^2$.

4. A silver halide photographic photosensitive material according to claim 1, wherein the hydrazine compound of formula (1) is replaced by the following formula (2):

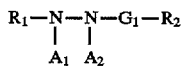

wherein $A_1$ and $A_2$ both represent hydrogen atoms or one of them represents a hydrogen atom and the other represents a sulfonyl group or an acyl group, $R_1$ represents an aliphatic group, an aromatic group or a heterocyclic group, $G_1$ represents a carbonyl group, a sulfonyl group, a sulfoxy group, a phosphoryl group, an oxalyl group or an iminomethylene group, and $R_2$ represents a hydrogen atom, an aliphatic group, an aromatic group, an alkoxy group, an aryloxy group, an amino group or a group represented by $-Q^+A^-$ wherein $Q^+$ represents a group containing a cationic group and $A^-$ represents an anion which is not necessary when Q+ contains a sulfo group.

5. A silver halide photographic photosensitive material according to claim 1, wherein the silver halide photographic emulsion layer includes a silver halide emulsion which is a surface latent image type emulsion.

6. A silver halide photographic photosensitive material according to claim 1, wherein the same at least one silver halide layer or at least one additional hydrophilic colloid layer contains both said hydrazine compound and said water-soluble vinyl polymer.

7. A silver halide photographic photosensitive material according to claim 6, wherein the at least one silver halide layer contains both said hydrazine compound and said water-soluble vinyl polymer.

* * * * *